US009873145B2

(12) United States Patent
Hosoi et al.

(10) Patent No.: US 9,873,145 B2
(45) Date of Patent: Jan. 23, 2018

(54) CAN-MANUFACTURING DEVICE

(71) Applicant: Universal Can Corporation, Tokyo (JP)

(72) Inventors: Masahiro Hosoi, Sunto-gun (JP); Atsushi Yamashita, Sunto-gun (JP)

(73) Assignee: Universal Can Corporation, Tokyo (JP)

( * ) Notice: Subject to any disclaimer, the term of this patent is extended or adjusted under 35 U.S.C. 154(b) by 875 days.

(21) Appl. No.: 14/370,304

(22) PCT Filed: Feb. 5, 2013

(86) PCT No.: PCT/JP2013/052620

§ 371 (c)(1),
(2) Date: Jul. 2, 2014

(87) PCT Pub. No.: WO2013/118728

PCT Pub. Date: Aug. 15, 2013

(65) Prior Publication Data

US 2015/0013422 A1 Jan. 15, 2015

(30) Foreign Application Priority Data

Feb. 9, 2012 (JP) ..... 2012-025840

(51) Int. Cl.
*B21D 22/26* (2006.01)
*B21D 51/26* (2006.01)

(52) U.S. Cl.
CPC ..... *B21D 22/26* (2013.01); *B21D 51/26* (2013.01); *B21D 51/2638* (2013.01); *B21D 51/2669* (2013.01)

(58) Field of Classification Search
CPC ..... B21D 51/26; B21D 51/2669; B21D 51/2615; B21D 51/2638; B21D 22/26; B65G 47/843; B65G 47/848
(Continued)

(56) References Cited

U.S. PATENT DOCUMENTS 4,519,232 A * 5/1985 Traczyk ..... B21D 51/2615 413/69
2009/0120044 A1* 5/2009 Fields ..... B65B 7/2835 198/471.1

FOREIGN PATENT DOCUMENTS

EP 0275369 A2 * 7/1988 ..... B21D 51/2638
JP 60-261631 A 12/1985
(Continued)

OTHER PUBLICATIONS

International Search Report dated May 14, 2013, issued for PCT/JP2013/052620.

*Primary Examiner* — R. K. Arundale
*Assistant Examiner* — Pradeep C Battula
(74) *Attorney, Agent, or Firm* — Locke Lord LLP

(57) ABSTRACT

To provide a variant-can having a narrow part in the vicinity of a bottom part by performing a diameter-reduction process up to the vicinity of the bottom part on a trunk part of a can-body made of metal in a can-manufacturing device which processes the can-body being held by a pocket-shaped conveying part while conveying. It is provided with: a can-body pocket which holds a can-body by being in contact with a part of an outer circumference surface of a trunk part of the can-body; a base pad which presses a bottom part of the can-body along a can-axis direction; a die in which the trunk part of the can-body is press-inserted; and a clamping ring which protrudes from the base pad toward the die and is provided so as to move back and forth along the can-axis direction.

3 Claims, 10 Drawing Sheets

(58) Field of Classification Search
USPC ..... 72/94, 348, 349; 198/377.04, 377.08,
198/471.1, 459.2, 803.5
See application file for complete search history.

(56) References Cited

FOREIGN PATENT DOCUMENTS

| | | | |
|---|---|---|---|
| JP | 08-010881 | A | 1/1996 |
| JP | 2003-200235 | A | 7/2003 |
| JP | 2003-305523 | A | 10/2003 |
| JP | 2004-188423 | A | 7/2004 |
| WO | WO-2008/77231 | A1 | 7/2008 |

* cited by examiner

CAN-MANUFACTURING DEVICE

TECHNICAL FIELD

The present invention relates to a can-manufacturing device of drawing a metal can-body in a can-manufacturing process of a beverage-can packing soft drink, beer or the like therein.

Priority is claimed on Japanese Patent Application No. 2012-25840, filed Feb. 9, 2012, the content of which is incorporated herein by reference.

A bottle-can for beverage made of aluminum alloy material is made by, for example, forming a plate material punched into a circular shape into a closed-end cylindrical shape by performing a drawing process, an ironing process and the like, and further performing a diameter-reduction process.

Patent Document 1 (PTL 1) describes a can-manufacturing apparatus for performing a diameter-reduction process on a closed-end cylindrical can-body. This can-manufacturing apparatus has a structure which reduces a diameter of a can-body by advancing a drawing die to a can-body which is mounted on a base pad; and it is possible to bring a diameter-reduction position of the drawing die near to the base pad by providing a guide ring on the drawing die for preventing a can-trunk from swelling out so as to move back with respect to the drawing die.

Patent Document 2 (PTL 2) describes a manufacturing method and a manufacturing apparatus which reduces a diameter of a can-trunk by drawing. In this case, by repeating the diameter-reduction processes in steps with holding the can along an axis direction, it is possible to form a can having a shape of reducing diameter thereof toward a bottom side or an opening side.

Patent Document 3 (PTL 3) describes a can-manufacturing apparatus having conveying pockets conveying a can-body between a drawing die and a base pad. In this can-manufacturing apparatus, the can-body held by the conveying pockets with an arc-shaped section disposed at even intervals is performed on a diameter-reduction process or a diameter-expansion process by the drawing die and rods disposed respectively both sides of the conveying pockets, so that multi-step processes can be performed in the apparatus continuously by providing drawing dies with variant shapes.

CITATION LIST

Patent Literature

[PTL 1] Japanese Unexamined Patent Application, First Publication No. 2003-200235
[PTL 2] Japanese Unexamined Patent Application, First Publication No. 2004-188423
[PTL 3] International Publication No. 2008/77231

SUMMARY OF INVENTION

Technical Problem

In such a forming process of a bottle-can, it is required to enlarge a deformation dimension in one process such as long deformation along the can-axis or large deformation of the diameter. However, in order to enlarge the deformation dimension in one process, an indentation load (what is called a neck-forming load) for pushing the can-trunk into the drawing die is increased, so that a can-bottom may sink or the can-trunk may swell out.

In recently years, it is required to work in a nearer part to the can-bottom than before in order to form a variant-can having a shape with steps of reduced-diameter parts and expanded-diameter parts from the can-bottom to the opening part.

If the reduced-diameter part is formed in the vicinity of the can-bottom using the apparatus of PTL 1, according to the structure in which the guide ring is further receded by abutting on the base pad, the reduced-diameter position can be near to the bottom part. However, because the guide ring is provided between the base pad and the drawing die, the reduced-diameter position is away from the bottom part at a length of the guide ring. In order to bring the reduced-diameter position closer to the bottom part in this structure, it is necessary to shorten the length of the guide ring. On the other hand, if the length of the guide ring is too small, it is difficult to prevent the can-trunk from swelling and the like. Furthermore, because the guide ring and the drawing die are separated, the can-trunk is not clamped at a part between the guide ring and the drawing die, so that the can-body may swell.

When the apparatus of PTL 2 is used, a flange is formed on an opening part previous to a forming process of a can-trunk, although a diameter cannot be expanded after forming the flange; so that, the design is restricted. That is to say, because the can in which the flange is formed is held between the opening part and the bottom thereof along the axis, it is not possible to expand the diameter. Accordingly, the opening part has the smallest diameter in a part formed from the opening side; and the bottom part has the smallest diameter in a part formed from the bottom side. Therefore, it is not possible to manufacture the variant-can having a narrow part at a middle part.

In the apparatus described in PTL 3, since the can-body is held in a state in which the conveying pocket is in contact with a can-trunk, it is not possible to provide the guide ring clamping an outer circumference surface of the can-trunk at a part in contact with the conveying pocket. That is to say, it is difficult to provide the guide ring having enough length for clamping the outer circumference surface of the can-trunk while processing. Particularly, if manufacturing a variant-cans or the like having a constricted shape in the vicinity of the can-bottom, swelling, elastic deformation or the like of the can-trunk may be formed. Moreover, since it has a structure holding the outer circumference surface of the can-trunk, the can-body cannot be stably held when a variant-can is manufactured so as to have a plurality of diameter-reduced parts and diameter-expanded parts at the can-trunk, the process cannot be performed in accordance with design.

The present invention is achieved in consideration of the above circumstances, and has an object to provide a variant-can having a narrow part in the vicinity of a bottom part by performing a diameter-reduction process to the vicinity of the bottom part on a trunk part of a can-body made of metal in a can-manufacturing device which processes the can-body being held by a pocket-shaped conveying part while conveying.

Solution to Problem

A can-manufacturing device of the present invention is a can-manufacturing device performing a diameter-reduction process on a trunk part of a can-body having a closed-end cylindrical shape with an open end, including: a can-body pocket which holds the can-body by being in contact with a part of an outer circumference surface of a trunk part of the can-body; a base pad which presses a bottom part of the can-body along a can-axis direction of the can-body by advancing and retreating along the can-axis direction with respect to the can-body pocket; a die which is disposed to face the base pad along the can-axis direction interposing the can-body pocket therebetween so as to perform a diameter-reduction process on the trunk part by being press-inserted the trunk part of the can-body along the can-axis direction; and a clamping ring which protrudes from the base pad toward the die and is provided so as to move back and forth along with the base pad along the can-axis direction with respect to the can-body pocket, the device in which: the can-body pocket has a plurality of holding surfaces extending in the can-axis direction along the trunk part of the can-body and being separated circumferentially from each other along the outer circumference surface; and the clamping ring has a plurality of arc-shaped clamping surfaces extending in the can-axis direction along the trunk part of the can-body and being inserted and extracted between the holding surfaces, so that a clamping surface is formed to clamp the outer circumference surface around substantially whole circumference in the vicinity of the bottom part of the can-body held by the can-body pocket by inserting the arc-shaped clamping surface of the clamping ring between the holding surfaces of the can-body pocket.

According to the can-manufacturing device, the outer circumference surface of the can-body can be clamped in the vicinity of the bottom part by the clamping surface having substantially a circumference surface formed by combining the can-body pocket and the clamping ring. As a result, even a variant-can or the like having a narrow part in the vicinity of the bottom part can be stably manufactured.

In this can-manufacturing device, it is preferable that the base pad and the clamping ring be provided so as to move relatively along the can-axis direction. Moreover, it is preferable that an energizing member which energizes and advances the clamping ring forwardly be attached with respect to the base pad along the can-axis direction.

In this case, even if the clamping ring advances along with the base pad and then is stopped by abutting on the die, the trunk part can be press-inserted deeper into the die by further advancing the base pad. Accordingly, the diameter-reduction process can be performed on the can-body up to the vicinity of the bottom part in a state in which the outer circumference surface is clamped.

Advanced Effects of Invention

According to a can-manufacturing device of the present invention, it is possible to provide a variant-can having a narrow part in the vicinity of a bottom part by performing a diameter-reduction process up to the vicinity of the bottom part on a trunk part of a can-body made of metal in a can-manufacturing device which processes the can-body being held by a pocket-shaped conveying part while conveying.

DESCRIPTION OF EMBODIMENTS

Below an embodiment of a can-manufacturing device of the present invention will be explained referring to drawings. A can-manufacturing device 10 of the present embodiment is a device which performs a diameter-reduction process on a trunk part 101 of a can-body 100 having a closed-end cylindrical shape with an open end.

Figure 1:
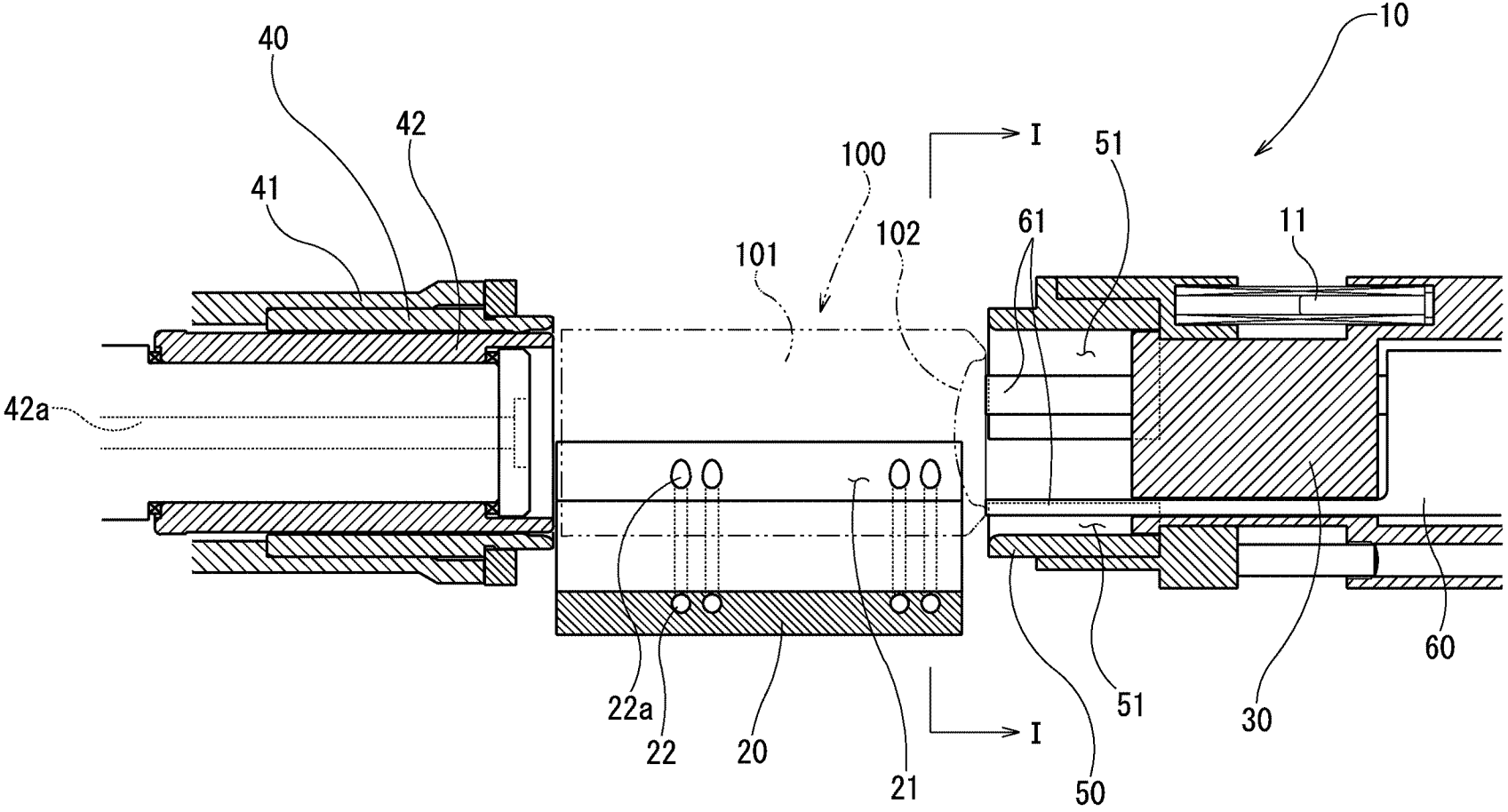
FIG. 1 It is a cross-sectional view showing a state in which a can-body before forming is held in a can-manufacturing device according to an embodiment of the present invention.

As shown in FIG. 1, the can-manufacturing device 10 is provided with: a can-body pocket 20 which holds the can-body 100 by being in contact with a part of an outer circumference surface of a trunk part 101 of the can-body 100; a base pad 30 moving back and forth along a can-axis direction of the can-body 100 with respect to the can-body pocket 20; a die 40 which is disposed to face the base pad 30 along the can-axis direction interposing the can-body pocket 20; and a clamping ring 50 which protrudes from the base pad 30 toward the die 40 and is provided so as to move back and forth along with the base pad 30 along the can-axis direction with respect to the can-body pocket 20.

Figure 2:
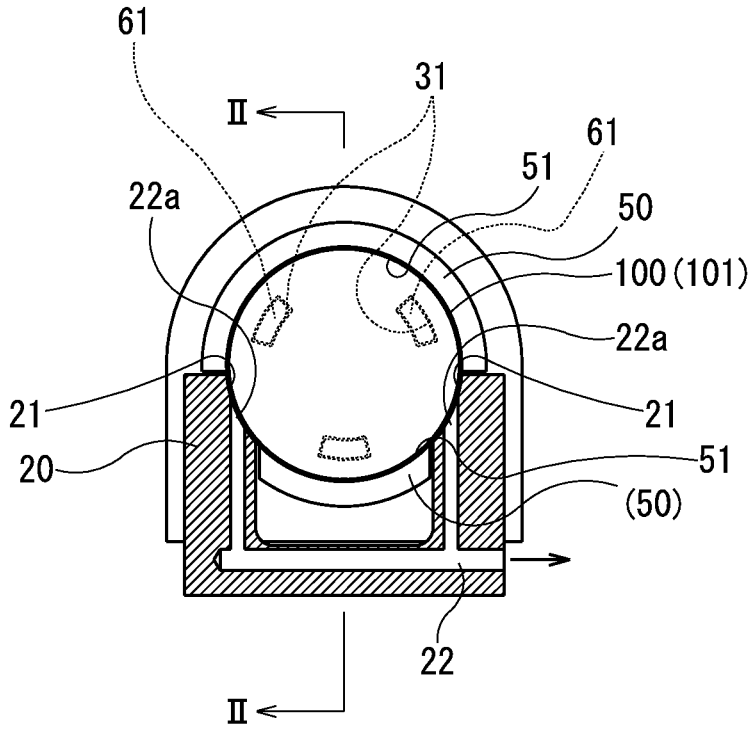
FIG. 2 It is a cross-sectional view taken along the line I-I in FIG. 1.

As shown in FIG. 1 and FIG. 2, the can-body pocket 20 has a plurality (in this embodiment, two) of arc-shaped holding surfaces 21 extending in the can-axis direction along the trunk part 101 of the can-body 100 and being separated circumferentially from each other along the outer circumference surface of the trunk part 101. In the can-body pocket 20, a suction passage 22 having a suction port 22*a* which opens at the holding surface 21 is formed. By using an external vacuum device (not illustrated) connected to the suction passage 22, the trunk part 101 of the can-body 100 abutting on the holding surface 21 is sucked, the can-body 100 can be held on the can-body pocket 20. FIG. 2 is a cross-sectional view taken along the line I-I in FIG. 1. FIG. 1 is a cross-sectional view taken along the line II-II in FIG. 2.

The base pad 30 is formed of elastic member such as rubber or the like into substantially a columnar shape, and connected to a driving device (not illustrated) so as to move back and forth along the can-axis direction. By advancing the base pad 30, a bottom part 102 of the can-body 100 held in the can-body pocket 20 is pushed along the can-axis direction, so that the can-body 100 can be press-inserted into the die 40.

The clamping ring 50 which is provided so as to protrude from the base pad 30 has a plurality (in this embodiment, two) of arc-shaped clamping surfaces 51 which extend in the can-axis direction along the trunk part 101 of the can-body 100 and are inserted into and retrieved from between the holding surfaces 21, as shown in FIG. 1 and FIG. 2. By inserting the arc-shaped clamping surfaces 51 into between the holding surfaces 21 of the can-body pocket 20, the arc-shaped surfaces 51 and the holding surfaces 21 form a clamping surface clamping substantially the whole outer circumference surface of the can-body 100 in the vicinity of the bottom part 102.

The clamping ring 50 is attached so as to move backward with respect to the base pad 30 (i.e., toward the right in the drawing), and energized forward (i.e., toward the left in the drawing) by a spring (an energizing member) 11 mounted between the base pad 30 and the clamping ring 50.

A plunger 60 is provided behind the base pad 30 (i.e., the right in the drawing). Three pushing bars 61 protruding forward from the plunger 60 are arranged in a circumferential direction with even intervals around the can-axis so that each of the top ends are in contact with the bottom part 102 of the can-body 100. In the base pad 30, through holes 31 in which the pushing bars 61 penetrate are formed. The plunger 60 is fixed so as not to be moved in the can-axis direction, and holds the can-body 100 so as not to retreat to the right in FIG. 1 than a prescribed position by abutting top ends of the pushing bars 61 on the bottom part 102 of the can-body 100 held at the prescribed position in the can-body pocket 20.

The die 40 which is disposed so as to interpose the can-body pocket 20 toward the base pad 30 and the clamping ring 50 is a cylindrical member into which the trunk part 101 of the can-body 100 is press-inserted, and is fixed on an inside of a cylindrical die-holder 41. By press-inserting the can-body 100 into the die 40 along the can-axis direction, the diameter-reduction process can be performed on the trunk part 101 of the can-body 100.

In the die 40, a knockout 42 having a cylindrical outer circumference surface is disposed, so that very small cylindrical space is formed between the die 40 and the knockout 42. The knockout 42 is attached to a driving device (not illustrated), so that the knockout 42 is advanced toward the right in the drawing along the can-axis direction with respect to the die 40 by the driving device and inserted into the trunk part 101 of the can-body 100 held in the can-body pocket 20.

The outer circumference surface of the knockout 42 is formed straight extending along the can-axis direction, and an inner circumference surface of the die 40 which is fitted outside the knockout 42 is formed to have an inner diameter in which only a top end part thereof is large. Accordingly, between the inner circumference surface of the die 40 and the outer circumference surface of the knockout 42, an introducing part with relatively large cylindrical shape is formed at the top end part, and a small cylindrical gap is formed after the introducing part for the most part except the top end part. Therefore, the trunk part 101 of the can-body 100 is press-inserted from the introducing part into the cylindrical gap so as to be deformed following the inner circumference surface of the die 40, and the diameter thereof is reduced.

Figure 3:
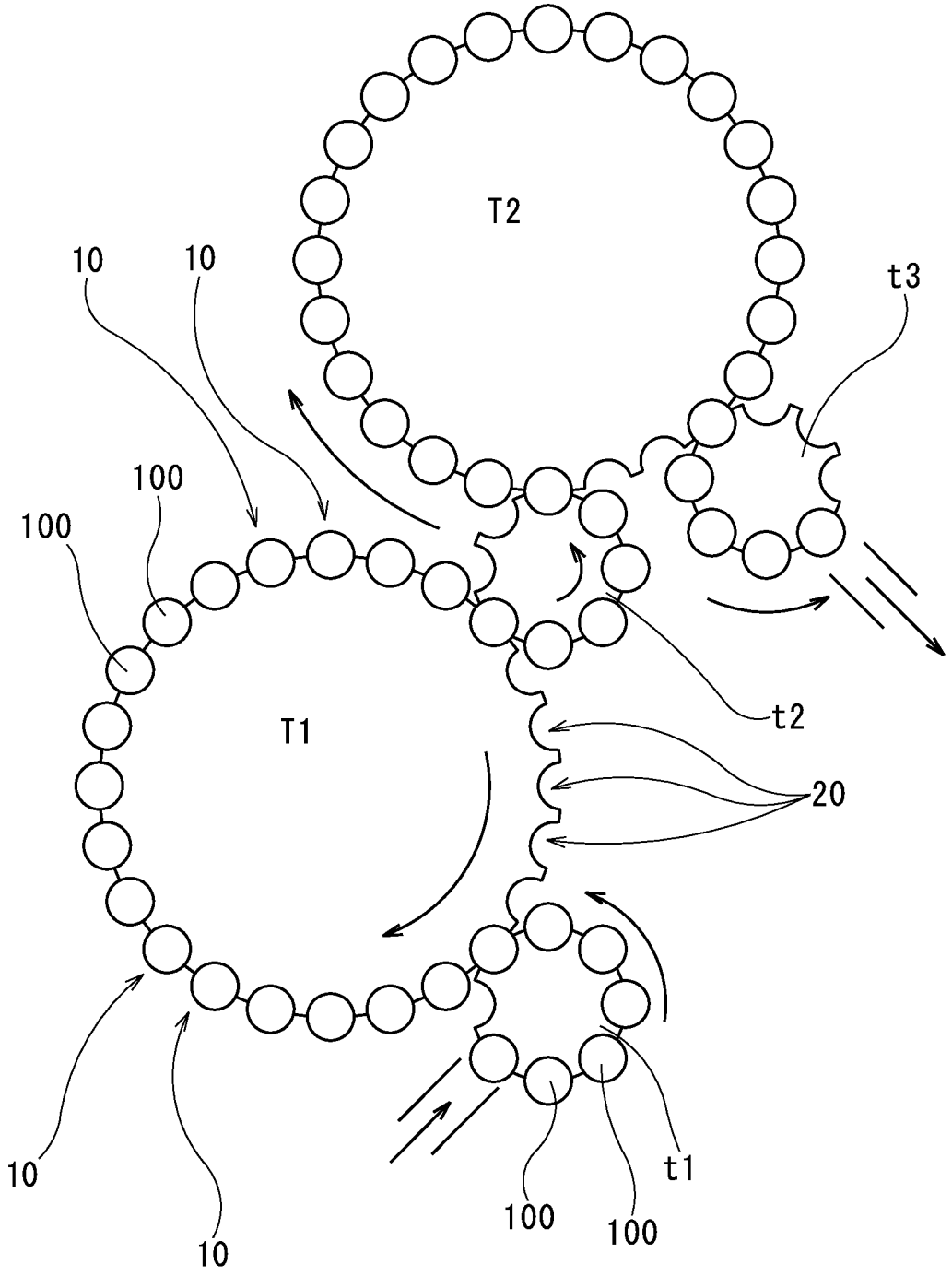
FIG. 3 It is a schematic view showing a can-manufacturing apparatus which performs processes with multi-steps while conveying the can-body.

The can-manufacturing device 10 described above, as shown in FIG. 3, can be used when multi-step processes are performed on the can-body 100 while continuously conveying the can-body 100 by a plurality of turrets T1 and T2. The turret T1 has the plurality of can-body pocket 20 which hold the can-body 100 supplied from a supplying turret t1, so that it is possible to convey the can-body 100 by rotation. The base pad 30, the clamping ring 50 and the like in each of the can-manufacturing devices 10 are moved back and forth by a cam mechanism and the like while the can-manufacturing devices 10 constructed corresponding to the can-body pocket 20 of the turret T1 are shifted along with the rotation of the turret T1, the formation process is performed on the can-body 100.

The can-body 100 processed in the turret T1 is transferred to a next turret T2 by a transferring turret t2. Also in the turret T2, the plurality of can-manufacturing devices are provided as in the turret T1, the forming process is performed on the can-body 100 along with the conveyance. The can-body 100 processed in the turret T2 is conveyed by a transferring turret t3. Although an apparatus is described as performing a forming process with two steps using the two turrets T1 and T2, the forming process is not limited to have two steps.

It will be described with referring the drawings for a case in which the can-body 100 is formed by using the can-manufacturing device 10. First, as shown in FIG. 1, in a state in which the base pad 30, the clamping ring 50, and the knockout 42 are retreated from the can-body pocket 20, the can-body 100 is abutted on the holding surface 21 of the can-body pocket 20. The can-body 100 is sucked and held at the suction port 22*a* through the suction passage 22.

Figure 4:
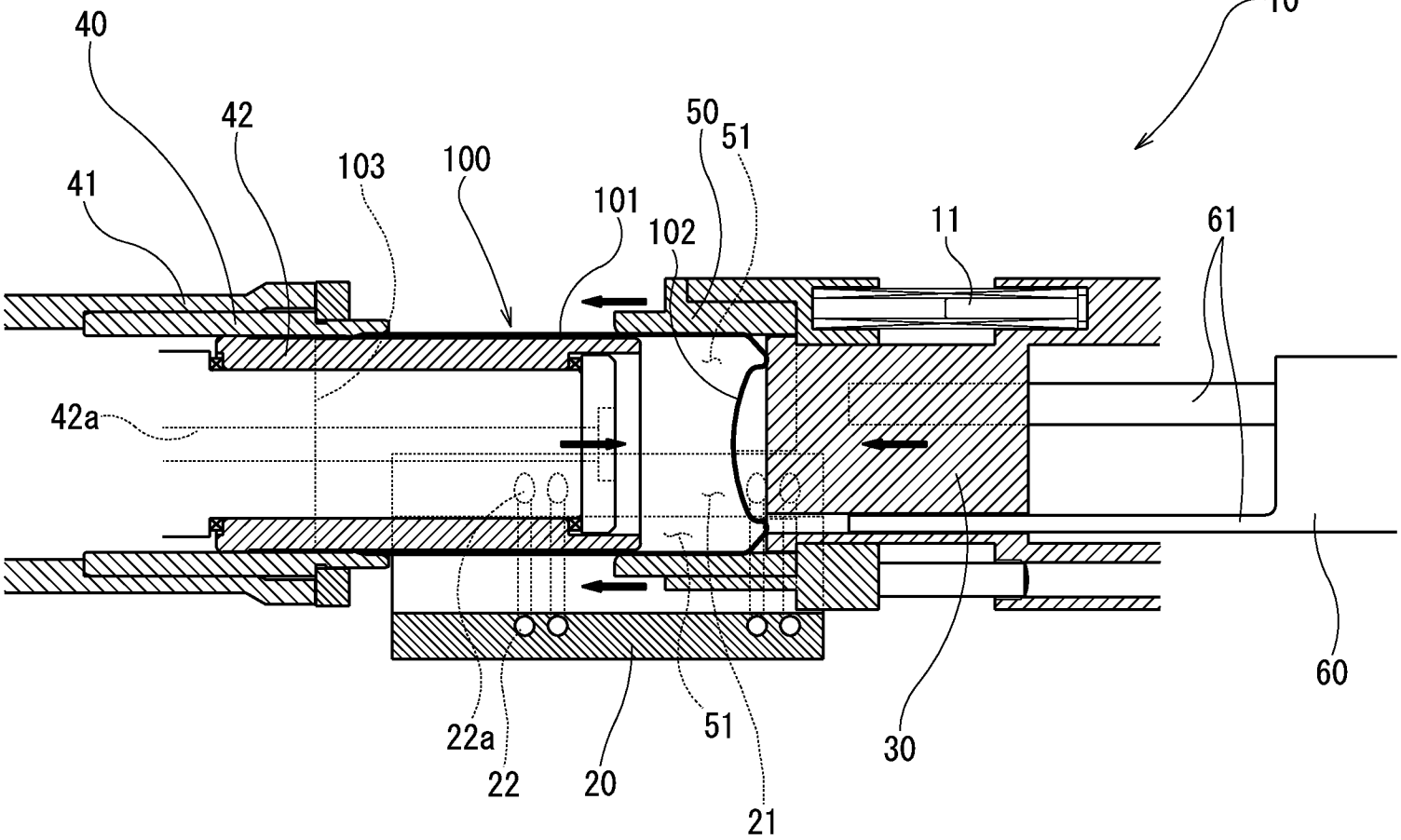
FIG. 4 It is a cross-sectional view showing a state in which an opening part of the can-body is press-inserted into a die with clamping an inner circumference surface of the can-body at the opening part side by advancing a knockout and clamping an outer circumference surface of the can-body at the bottom part side by advancing the clamping ring and the base pad in the can-manufacturing device shown in FIG. 1.

Next, as shown in FIG. 4, the base pad 30, the clamping ring 50 and the knockout 42 are advanced respectively toward the can-body 100 in the directions of the arrows in the drawing. Thereby, the can-body 100 is held at the inner circumference surface of the trunk part 101 at an opening part 103 side by the knockout 42, and is clamped at the outer circumference surface of the trunk part 101 in the vicinity of the bottom part 102 by the holding surface 21 and the arc-shaped clamping surfaces 51. Then, the can-body 100 is moved toward the left in the drawing by the base pad 30 in a state in which the can-axis is corresponded to the axes of the clamping ring 50 and the knockout 42, and the trunk part 101 is press-inserted into the die 40.

For moving the can-body 100, the hold by suction through the suction passage 22 is released. For inserting the knockout 42 into the trunk part 101 of the can-body 100, air is supplied via an air passage 42*a* formed in the knockout 42 into the can-body 100 from an external air supplying device (not illustrated); after that, until the knockout 42 is extracted from the trunk part 101, the inside of the can-body 100 is maintained at a positive pressure.

Figure 5:
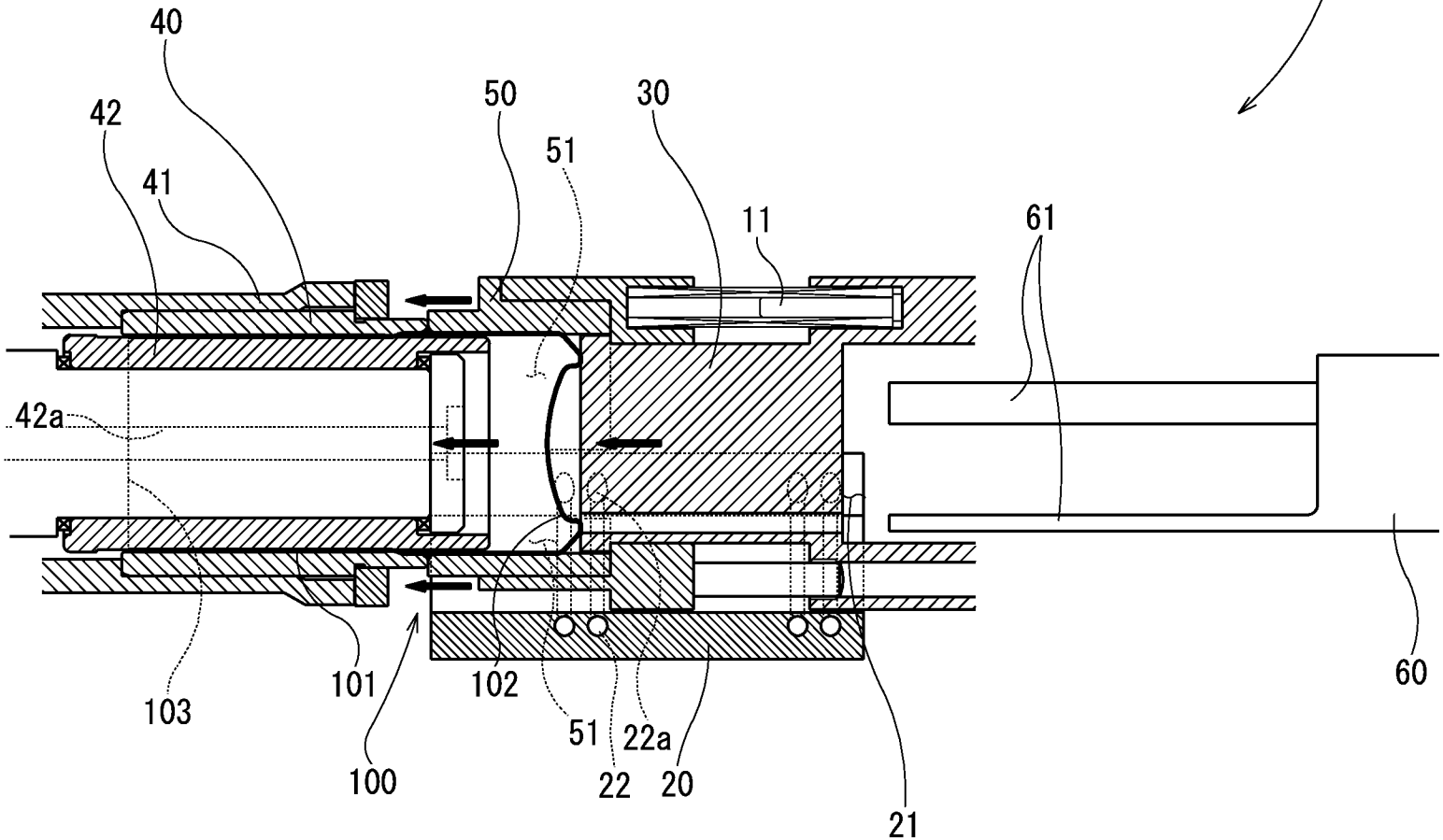
FIG. 5 It is a cross-sectional view showing a state in which the can-body is advanced with being clamped at the inner and outer circumference surfaces by the knockout and the clamping ring so that a trunk part thereof is press-inserted deeper into the die in the can-manufacturing device shown in FIG. 4.

The base pad 30, the clamping ring 50 and the knockout 42 are further advanced so that a top end part of the clamping ring 50 and a top end part of the knockout 42 are in a same position along the can-axis direction. Then, as shown in FIG. 5, the base pad 30 and the clamping ring 50 are further advanced toward the left in the drawing, but the knockout 42 is retreated toward the left in the drawing. That is to say, with maintaining an interval along the can-axis direction between the base pad 30 and the knockout 42, the knockout 42 is moved toward the left in the drawing along with the base pad 30 and the clamping ring 50, so that the can-body 100 is press-inserted deeper into the die 40.

Figure 6:
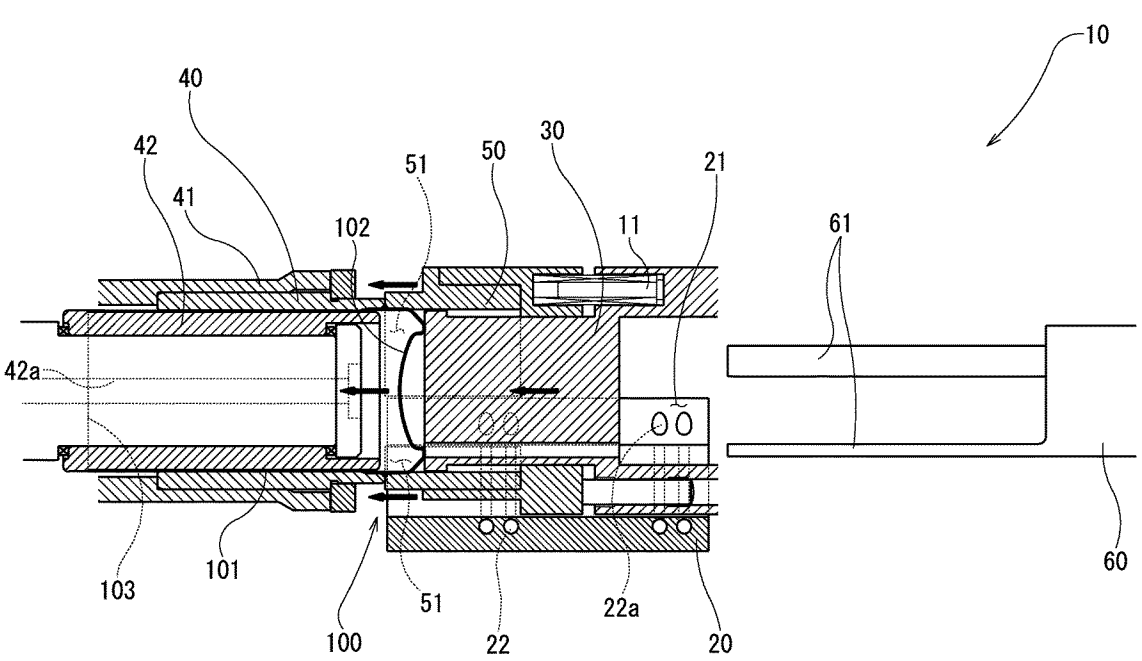
FIG. 6 It is a cross-sectional view showing a state in which an advance of the clamping ring is stopped by contact of a top-end part of the clamping ring with a top-end part of the die, and a state in which the trunk part of the can-body is press-inserted into the die up to the vicinity of the bottom part by further advancing the base pad in the can-manufacturing device shown in FIG. 5.

Then, after the top end part of the clamping ring 50 is abutted on the top end part of the die 40 as shown in FIG. 5, the base pad 30 is further advanced toward the left in the drawing, and the trunk part 101 of the can-body 100 is press-inserted into the die 40 up to the vicinity of the bottom part 102 as shown in FIG. 6. In this situation, the clamping ring 50 cannot be further moved forward after abutting on the die 40, so that the base pad 30 is moved forward with squeezing the spring 11 which is mounted between the base pad 30 and the clamping ring 50. Thereby, the can-body 100 is press-inserted into the die 40 up to a prescribed position in a state in which the outer circumference surface is clamped by the clamping ring 50, the diameter of the trunk part 101 is reduced up to the vicinity of the bottom part 102.

Figure 7:
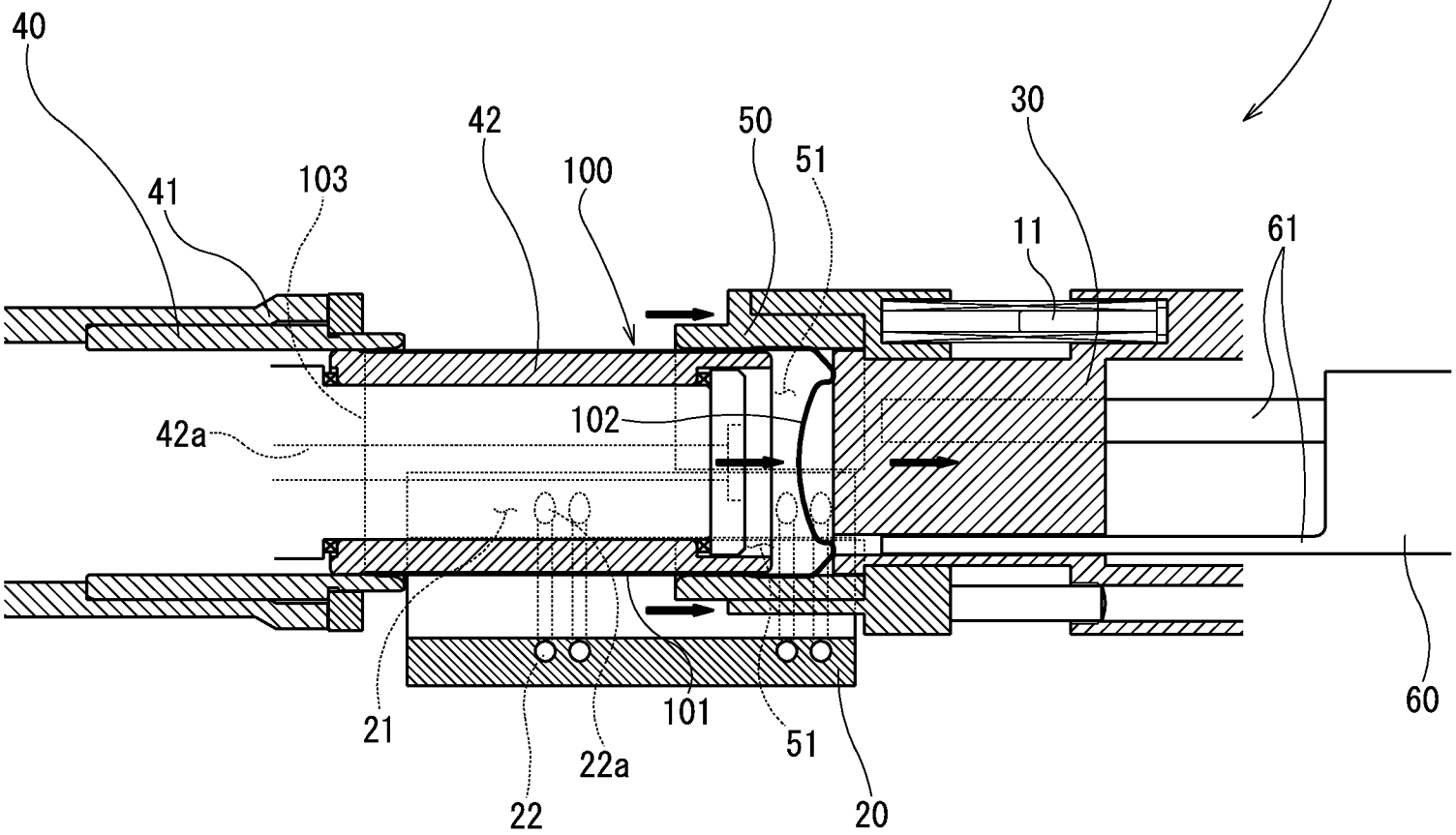
FIG. 7 It is a cross-sectional view showing a state in which the can-body is moved to a held position before forming while being clamped at the inner and outer circumference surfaces of the can-body by the knockout and the clamping ring in the can-manufacturing device shown in FIG. 6.
Figure 8:
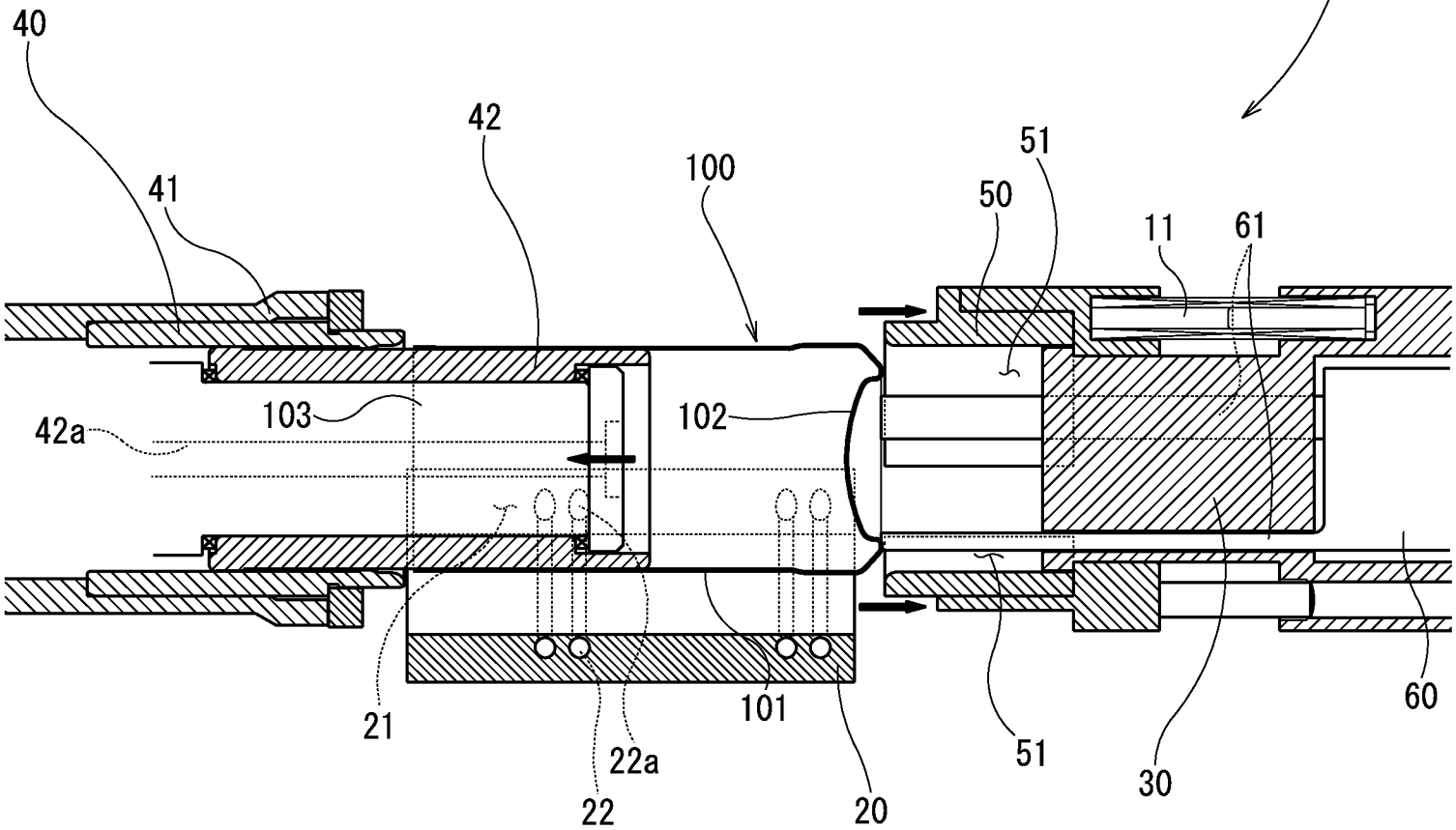
FIG. 8 It is a cross-sectional view showing a state in which restriction of the trunk part of the can-body at the inner and outer circumferential surfaces is released by retreat of the clamping ring and the knockout in the can-manufacturing device shown in FIG. 7.
Figure 9:
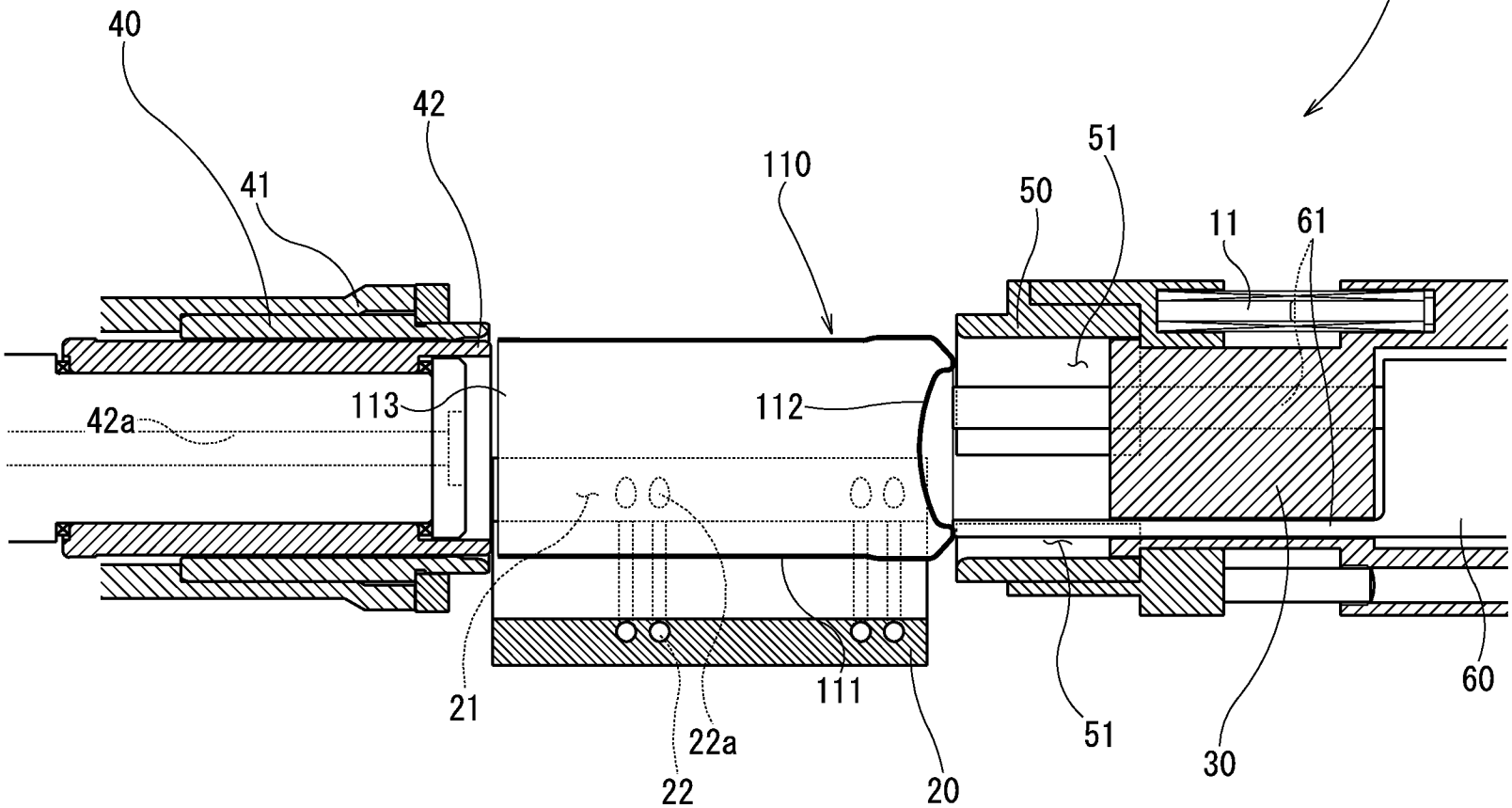
FIG. 9 It is a cross-sectional view showing a state in which the can-body which is performed a diameter-reduction process on to the vicinity of the bottom part is held by the can-body pocket in the can-manufacturing device shown in FIG. 8.

Subsequently, as shown in FIG. 7, along with the can-body 100 in which the diameter of the trunk part 101 is reduced in a prescribed range, the base pad 30, the clamping ring 50 and the knockout 42 is moved toward the right in the drawing. Then, as shown in FIG. 8, the can-body 100 is held by suction on the can-body pocket 20 at a prescribed position in which the bottom part 102 is abutted on the pushing bars 61; and the base pad 30, the clamping ring 50 and the knockout 42 are respectively retreated (FIG. 9). As a result, a can-body 110 in which the diameter is reduced at a trunk part 111 from an opening part 113 to the vicinity of a bottom part 112 can be collected from the can-body pocket 20.

Also when the knockout 42 which is inserted into the can-body 100 is moved back, by air supplied through the air passage 42*a*, the inside of the can-body 100 is maintained at a positive pressure. Therefore, the knockout 42 is not moved back with holding the can-body 100; and the can-body 100 is held by the can-body pocket 20. When the knockout 42 is released from the can-body 100, air supply through the air passage 42*a* is stopped.

As explained above, according to the can-manufacturing device 10 of the present embodiment, since the outer circumference surface of the trunk part 101 of the can-body 100 in the vicinity of the bottom part 102 is clamped by the arc-shaped clamping surface 51 of the clamping ring 50 and the holding surface 21 of the can-body pocket 20, the trunk part 101 in the vicinity of the bottom part 102 is prevented from swelling while the diameter-reduction process. Moreover, since the clamping ring 50 can be moved backward with respect to the base pad 30 press-inserting the can-body 100 into the die 40, the can-body 100 can be press-inserted into the die 40 up to the vicinity of the bottom part 102 with clamping the outer circumference surface of the trunk part 101 so as to prevent swelling, so that the can-body 110 can be formed to have a reduced diameter from the opening part 113 to a diameter-reduction position A in the vicinity of the bottom part 112 (refer to FIG. 10).

Subsequently, with respect to the can-body 110 in which such a diameter-reduction process is performed, by a diameter-expansion process such as press-inserting a core having a larger outer diameter than the inner diameter of the can-body 110 in the vicinity of the opening part 113 and the like, a can-body 120 in which a diameter thereof is expanded from an opening part 123 to a prescribed diameter-expansion position B can be obtained (refer to FIG. 10). Since the diameter-expansion position B is near to the opening part 123 than the diameter-reduction position A, the can-body 120 has a shape in which a trunk part 121 is constricted at the vicinity of a bottom part 122.

Moreover, by further performing a diameter-reduction process on a part near to the opening part 123 than the diameter-expansion position B of the can-body 120 in which the diameter-reduction process and the diameter-expansion process are performed, a can-body 130 can be formed with a plurality of swelled parts and narrow parts so as to have a shape in which a diameter of a part from an opening part 133 to a diameter-reduction position C is reduced. In this can-body 130, both a bottom part 132 side and the opening part 133 side beside the diameter-expansion position B are reduced in diameter.

The above-described can-manufacturing device 10 can be used for forming the can-body 130. In this case, the diameter-reduction can be performed up to an intended diameter-reduction position C by altering the shape of the die 40, a press-inserting length of the can-body 120 into the die and the like.

The can-body 120 is a variant-can in which the trunk part 121 has a narrow part, so that it is difficult to hold the can-body 120 in the can-body pocket 20 in a stable posture by merely abutting on the cylindrical-surface-shaped holding surface 21. However, in the can-manufacturing device 10, the outer circumference surface of the can-body 120 in the vicinity of the bottom part 122 is clamped by the clamping ring 50 and the can-body pocket 20, so that the diameter-reduction process can be performed on the can-body 120 having the swelled parts and the narrow parts in the trunk part 121 with stably holding the can-body 120. Furthermore, the elastic deformation at the bottom part 122 and the trunk part 121 at the diameter-reduction position A can be prevented while the diameter-reduction process.

Figure 10:
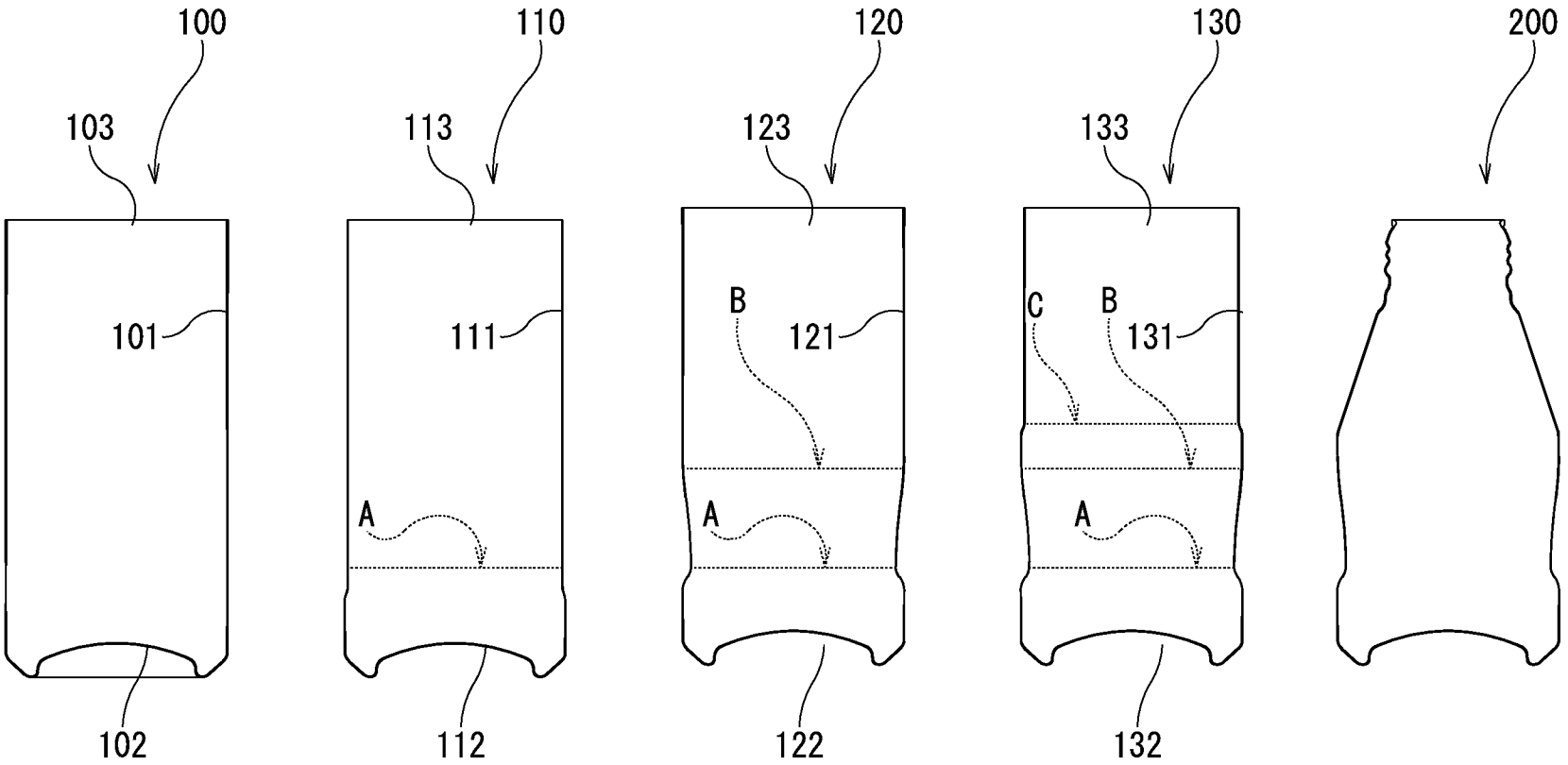
FIG. 10 It is a cross-sectional view showing shapes of bottle-cans in processes manufactured by the can-manufacturing device according to the present invention.

By further performing a drawing process and the like on the can-body 130 obtained as above, as shown in FIG. 10, a bottle-can 200 having a narrow part in the vicinity of a bottom part can be obtained.

The present invention is not limited to the above-described embodiments and various modifications may be made without departing from the scope of the present invention.

For example, in the can-manufacturing device of the above embodiment, the structure is employed so that the die is not moved with respect to the can-body pocket. However, in this can-manufacturing device, the die can be provided so as to move back and forth along the can-axis direction with respect to the can-body pocket. In this case, moreover, as the can-manufacturing device of the above embodiment, the structure can be employed so that a clamping ring having an arc-shaped clamping surface clamping an outer circumference surface of a trunk part of a can-body is provided at the die side; and an ark-shaped holding surface forming an arc-shaped clamping surface by being combined with the die-side clamping surface is provided at a can-body pocket.

INDUSTRIAL APPLICABILITY

It is possible to provide a variant-can having a narrow part in the vicinity of a bottom part by performing a diameter-reduction process up to the vicinity of the bottom part on a trunk part of a can-body made of metal in a can-manufacturing device which processes the can-body being held by a pocket-shaped conveying part while conveying.

DESCRIPTION OF REFERENCE SYMBOLS

10 can-manufacturing device
11 spring (energizing member)
20 can-body pocket
21 holding surface
22 suction passage
22*a* suction port
30 base pad
31 through hole
40 die
41 die-holder
42 knockout
42*a* air passage
50 clamping ring
51 arc-shaped clamping surface
60 plunger
61 pushing bar
100, 110, 120, 130 can-body
101, 111, 121, 131 trunk part
102, 112, 122, 132 bottom part
103, 113, 123, 133 opening part
200 bottle-can
T1, T2 turret
t1 supplying turret
t2, t3 transferring turret

What is claimed is:

1. A can-manufacturing device performing a diameter-reduction process on a trunk part of a can-body having a closed-end cylindrical shape with an open end, comprising:

a can-body pocket which holds the can-body by being in contact with a part of an outer circumference surface of a trunk part of the can-body;

a base pad which presses a bottom part of the can-body along a can-axis direction of the can-body by advancing and retreating along the can-axis direction with respect to the can-body pocket;

a die which is disposed to face the base pad along the can-axis direction interposing the can-body pocket therebetween so as to perform a diameter-reduction process on the trunk part by press-inserting the trunk part of the can-body along the can-axis direction; and a clamping ring which protrudes from the base pad toward the die and is provided so as to move back and forth along with the base pad along the can-axis direction with respect to the can-body pocket, the device wherein:

the can-body pocket has a plurality of holding surfaces extending in the can-axis direction along the trunk part of the can-body and being separated circumferentially from each other along the outer circumference surface; and the clamping ring has a plurality of arc-shaped clamping surfaces extending in the can-axis direction along the trunk part of the can-body and being inserted and extracted between the holding surfaces, so that a clamping surface is formed to clamp the outer circumference surface around substantially whole circumference in the vicinity of the bottom part of the can-body held by the can-body pocket by inserting the arc-shaped clamping surface of the clamping ring between the holding surfaces of the can-body pocket.

2. The can-manufacturing device according to claim 1, wherein the base pad and the clamping ring are provided so as to move relatively along the can-axis direction.

3. The can-manufacturing device according to claim 2, wherein an energizing member which energizes and advances the clamping ring forwardly is attached with respect to the base pad along the can-axis direction.

* * * * *